US008444019B2

(12) United States Patent
Lucey et al.

(10) Patent No.: US 8,444,019 B2
(45) Date of Patent: May 21, 2013

(54) WIPE AND SEAL PRODUCT PUMP

(75) Inventors: Ryan D. Lucey, Woodbury, MN (US); Anthony L. Kramer, Woodbury, MN (US); Paul R. Kraus, Apple Valley, MN (US); Richard J. Mehus, Richfield, MN (US); Sherri L. Tischler, Inver Grove Heights, MN (US); Mihnea A. Popa, Inver Grove Heights, MN (US); Brian P. Carlson, Lakeville, MN (US)

(73) Assignee: Ecolab USA Inc., St. Paul, MN (US)

( * ) Notice: Subject to any disclaimer, the term of this patent is extended or adjusted under 35 U.S.C. 154(b) by 371 days.

(21) Appl. No.: 12/851,905

(22) Filed: Aug. 6, 2010

(65) Prior Publication Data

US 2011/0031275 A1 Feb. 10, 2011

Related U.S. Application Data

(60) Provisional application No. 61/232,187, filed on Aug. 7, 2009.

(51) Int. Cl.
*B67D 1/08* (2006.01)

(52) U.S. Cl.
USPC ..... 222/148; 222/321.3

(58) Field of Classification Search
USPC ..... 222/148–151, 78, 207, 209, 256–257, 222/321.3, 321.6, 383.1, 383.3, 340, 325, 222/327, 386–386.5, 336, 339, 342, 153.13, 222/321.7
See application file for complete search history.

(56) References Cited

U.S. PATENT DOCUMENTS

| | | | | |
|---|---|---|---|---|
| 3,568,891 | A * | 3/1971 | Parish | 222/213 |
| 3,752,370 | A * | 8/1973 | Davenport | 222/514 |
| 4,989,790 | A | 2/1991 | Martin et al. | |
| 5,102,017 | A * | 4/1992 | Dirksing | 222/213 |
| 5,105,988 | A * | 4/1992 | Knickerbocker | 222/148 |
| 5,207,785 | A * | 5/1993 | Knickerbocker | 222/148 |
| 5,482,187 | A * | 1/1996 | Poulsen et al. | 222/207 |
| 5,657,907 | A | 8/1997 | Dobbs et al. | |
| 5,785,208 | A * | 7/1998 | Dobbs et al. | 222/148 |
| 6,158,625 | A * | 12/2000 | Siegel et al. | 222/148 |
| 6,223,746 | B1 * | 5/2001 | Jewett et al. | 128/203.12 |
| 6,257,451 | B1 * | 7/2001 | Siegel et al. | 222/148 |
| 6,966,465 | B2 * | 11/2005 | Kang | 222/321.9 |
| 7,059,546 | B2 | 6/2006 | Ogata et al. | |

(Continued)

FOREIGN PATENT DOCUMENTS

| | | |
|---|---|---|
| EP | 1 245 499 B1 | 10/2002 |
| EP | 1 570 910 A1 | 9/2005 |

(Continued)

OTHER PUBLICATIONS

International Search Report from corresponding Application Serial No. PCT/IB2010/053576 mailed Jun. 29, 2011.

*Primary Examiner* — Kevin P Shaver
*Assistant Examiner* — Andrew P Bainbridge
(74) *Attorney, Agent, or Firm* — IPLM Group, P.A.

(57) ABSTRACT

A product dispensing system is provided. The product dispensing system includes a dispensing device and a sealing assembly. The dispensing device is configured and arranged to pass product out of a dispensing orifice in the product dispensing system. The sealing assembly is configured and arranged to wipe and seal the dispensing orifice to prevent exposure of unused product with ambient air when the product dispensing system is not dispensing product.

16 Claims, 13 Drawing Sheets

U.S. PATENT DOCUMENTS

| | | | |
|---|---|---|---|
| 7,178,694 | B2 | 2/2007 | Costa et al. |
| 7,464,839 | B2 | 12/2008 | Heukamp |
| 7,510,102 | B2 | 3/2009 | Schmitt |
| 7,513,396 | B2 | 4/2009 | Pardes et al. |
| 7,527,173 | B2 | 5/2009 | Lasserre et al. |
| 2005/0184094 | A1 | 8/2005 | Costa et al. |
| 2007/0045347 | A1 | 3/2007 | Auer |
| 2007/0262078 | A1 | 11/2007 | Sheffler et al. |
| 2008/0302835 | A1 | 12/2008 | Luechinger et al. |
| 2008/0308579 | A1 | 12/2008 | Luechinger |
| 2008/0314934 | A1 | 12/2008 | Decottignies |
| 2009/0008412 | A1 | 1/2009 | Choi et al. |
| 2009/0008413 | A1 | 1/2009 | Choi et al. |
| 2009/0014480 | A1 | 1/2009 | Perignon |
| 2009/0014481 | A1 | 1/2009 | Benetti |
| 2009/0026224 | A1 | 1/2009 | Duquet et al. |
| 2009/0032487 | A1 | 2/2009 | Rekstad |
| 2009/0045223 | A1 | 2/2009 | Laidler et al. |
| 2009/0050233 | A1 | 2/2009 | Lawrence et al. |
| 2009/0071988 | A1 | 3/2009 | Nybakke |
| 2009/0078334 | A1 | 3/2009 | Nufer |
| 2009/0084752 | A1 | 4/2009 | Coulson |
| 2009/0090690 | A1 | 4/2009 | Walton et al. |
| 2009/0101677 | A1 | 4/2009 | Rossignol |
| 2009/0101679 | A1 | 4/2009 | Muderlak |
| 2009/0114681 | A1 | 5/2009 | Mabry |
| 2009/0127287 | A1 | 5/2009 | Faller |

FOREIGN PATENT DOCUMENTS

| | | | |
|---|---|---|---|
| EP | 1 588 774 | A1 | 10/2005 |
| EP | 1 717 162 | A1 | 11/2006 |
| EP | 1 749 582 | A1 | 2/2007 |
| EP | 1 825 738 | A1 | 8/2007 |
| EP | 2 019 048 | A1 | 1/2009 |
| EP | 2 045 192 | A1 | 4/2009 |
| EP | 2 060 503 | A2 | 5/2009 |
| GB | 2 450 105 | A | 12/2008 |
| GB | 2 453 018 | A | 3/2009 |
| GB | 2 454 926 | A | 5/2009 |
| JP | 07-251105 | | 10/1995 |
| JP | 2005-230800 | A | 9/2005 |
| JP | 2005-263229 | A | 9/2005 |
| JP | 2008-296987 | A | 12/2008 |
| WO | WO 02/26392 | A1 | 4/2002 |
| WO | WO 2005/067774 | A1 | 7/2005 |
| WO | WO 2006/056034 | A2 | 6/2006 |
| WO | WO 2007/030203 | A2 | 3/2007 |
| WO | WO 2007/110596 | A1 | 10/2007 |
| WO | WO 2007/136678 | A2 | 11/2007 |
| WO | WO 2008/017939 | A1 | 2/2008 |
| WO | WO 2008/028195 | A2 | 3/2008 |
| WO | WO 2008/110387 | A2 | 9/2008 |
| WO | WO 2009/000786 | A2 | 12/2008 |
| WO | WO 2009/033053 | A1 | 3/2009 |

* cited by examiner

WIPE AND SEAL PRODUCT PUMP

CROSS-REFERENCE TO RELATED APPLICATION

This application claims priority from U.S. Provisional Application Ser. No. 61/232,187, filed Aug. 7, 2009, entitled the same as above, the disclosure of which is incorporated herein in its entirety, by reference.

BACKGROUND

Dispensing devices are commonly used to dispense personal care product such as hand cleansers, lotions, waterless hand sanitizers and the like. Some types of products that are dispensed with dispensing devices have a tendency to dry up when exposed to ambient air. The drying up of the product can leave a buildup in dispensing orifices of the dispensing device which can result in the dispensing device failing to perform as designed.

For the reasons stated above and for other reasons stated below which will become apparent to those skilled in the art upon reading and understanding the present specification, there is a need in the art for a dispensing device that presents unused product from drying up in the dispensing orifice of dispensing device and/or removing any buildup at the dispensing orifice.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a product dispensing system is provided. The product dispensing system includes a dispensing device and a sealing assembly. The dispensing device is configured and arranged to pass product out of a dispensing orifice in the product dispensing system. The sealing assembly is configured and arranged to wipe and seal the dispensing orifice to prevent exposure of unused product with ambient air when the product dispensing system is not dispensing product.

BRIEF DESCRIPTION OF THE DRAWINGS

The present invention can be more easily understood and further advantages and uses thereof more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Embodiments provide dispensing systems that clear product near dispensing orifices and seal the dispensing orifices when not in use. The wipe and seal embodiments are employed when using products that are prone to drying such as, but not limited to, soaps, sanitizers and lotions. In addition, embodiments can be used on any product that is prone to excessive product buildup and erratic spray. In at least one embodiment, a wipe and seal dispensing pump head (dispensing device) is designed to be coupled to a container that contains the product. Moreover, in at least one embodiment, the dispensing device is intended to be disposed of after the product in the container is used up. In embodiments, the device wipes and then seals the dispensing orifices between uses. The wiping action removes dried residual product from the dispensing orifice prior to and after dispensing and thus reduces the chances of an erratic spray pattern coming from the dispensing orifice. In an embodiment, the sealing action reduces the drying rate of the product in a dispensing system's pump head thus minimizing the amount of dried residual product. An example of a simple dispensing pump head 200 is illustrated in FIGS. 1I and 1J which is discussed further in detail below. In one embodiment, a delay system is implemented to delay the dispensing of product until after a seal is completely removed from a dispensing orifice of the product dispensing system. Further in some embodiments as described below, the mechanism of activating a wipe and seal member is designed into a normal dispensing activation member so that the user does not have to manually trigger a separate wipe and seal member.

Figure 1A:
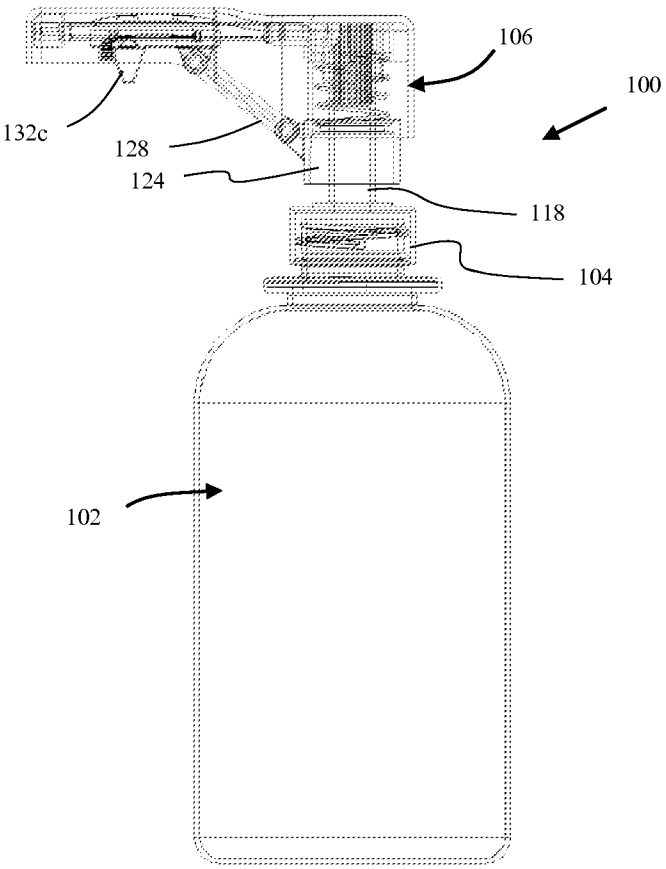
FIG. 1A is side view of a dispensing system of one embodiment of the present invention.

Referring to FIG. 1A, a first embodiment of a dispensing system 100 is illustrated. This embodiment can be referred to as a push arm wipe and seal embodiment. This dispensing system 100 includes a container 102 that contains product (not shown) and a dispensing pump head 106. The pump head 106 is threadably coupled to the container 102 via connector 104. An activation rod 118 (that includes a pickup tube) extends from the pump head 106 into the container 102. The pickup tube of the activation rod 118 picks up product in the container 102 and delivers it to the pump head 106 when the pump head 106 is activated (depressed) as known in the art.

Figure 1B:
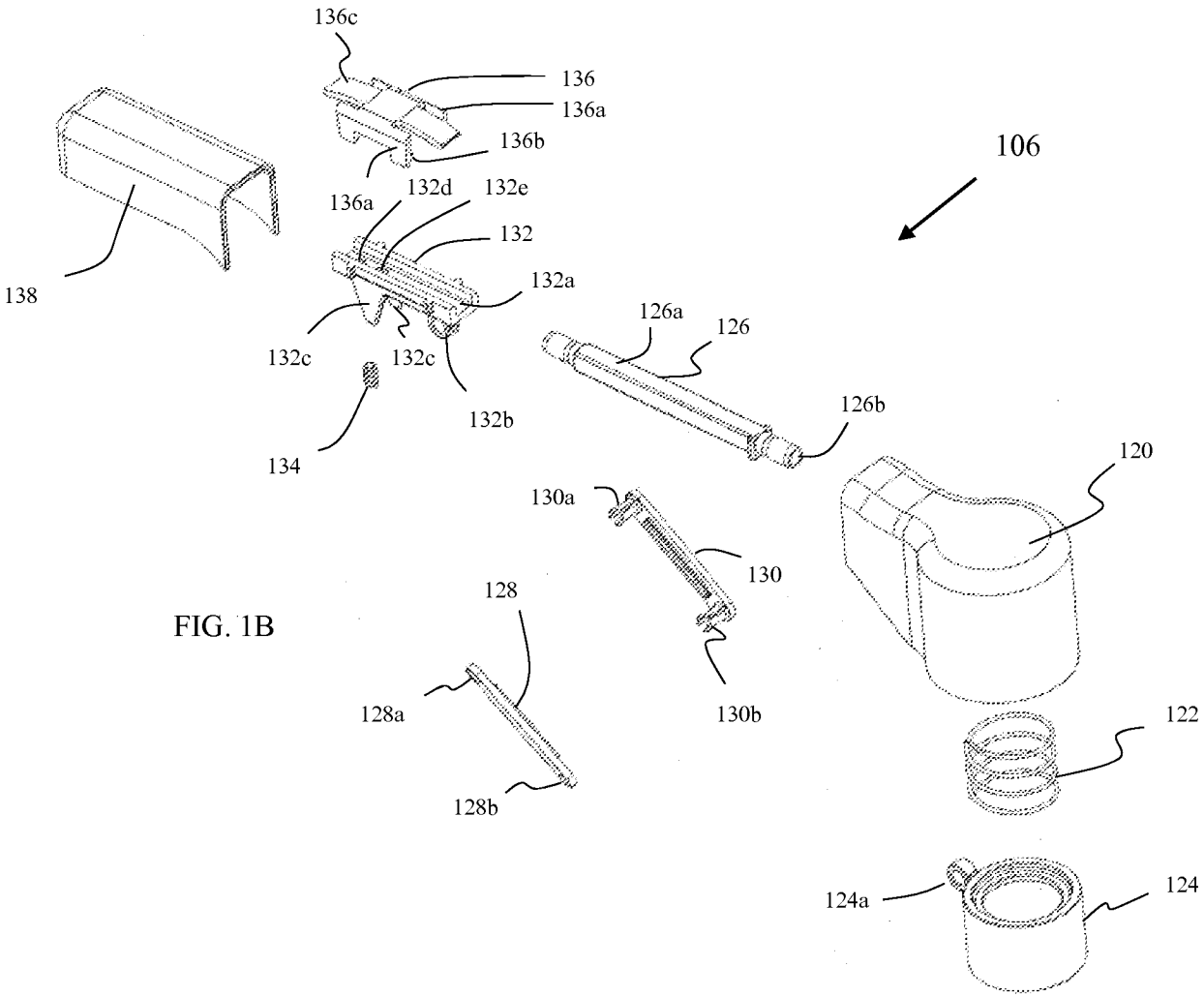
FIG. 1B is an unassembled side perspective view of a pump head of the dispensing system of FIG. 1A.
Figure 1C:
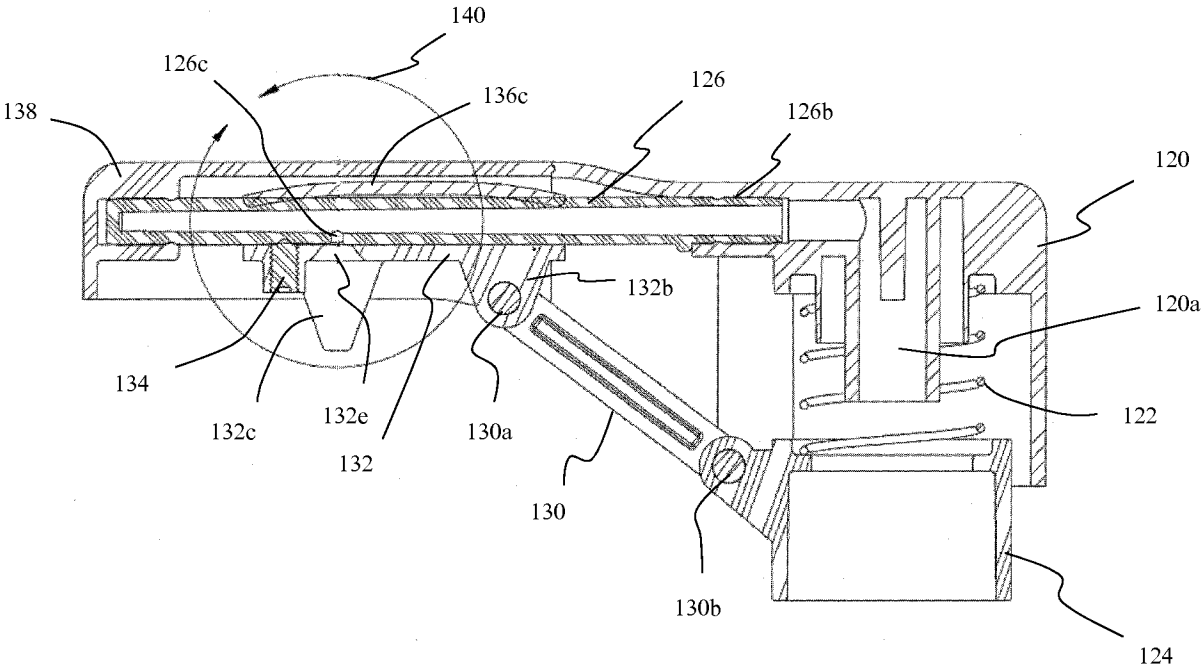
FIG. 1C is a cross-sectional side view of the pump head of the dispensing system of FIG. 1A.

The pump head 106 is further illustrated in the unassembled view of FIG. 1B and the cross sectional side view of FIG. 1C. As illustrated, the pump head 106 includes a housing base 124. The housing base 124 has a central passage in which the activation rod 118 extends. An end of the activation rod is received in an internal passage 120*a* in a manipulation housing 120. The manipulation housing 120 is separated from the housing base 124 by a compression spring 122. The compression spring 122 is received in an interior chamber of the manipulation housing 120 and provides a biasing force that pushes the manipulation housing 120 away from the housing base 124. When a user asserts a force on the manipulation housing 120 towards the housing base 124 countering the biasing force, the activation rod 118 (pickup tube) picks up product and delivers it to the pump head 106.

The pump head 106 of this embodiment further includes a deliver tube 126 and a slide base 132. The delivery tube 126 has a connection end 126*b* that is coupled to receive product from the internal passage 120*a* of the manipulation housing 120. The delivery tube 126 in this embodiment further has a mid section 126*a* that has an external square cross-sectional shape in this embodiment. The mid section 126*a* of the delivery tube 126 further includes a dispensing orifice 126*c*. The slide base 132 includes a track surface 132*a* that is designed to slidably engage the mid section 126*a* of the delivery tube 126. The slide base 132 includes a dispensing opening 132*e* that selectively aligns with the dispensing orifice 126*c* of the delivery tube 126. The pump head 106 further includes a linkage that connects the housing base 124 to the slide base 132. The linkage in this embodiment includes linkage members 128 and 130. Linkage 130 has split connection rod members 130*a* and 130*b* that extend proximate opposite ends of an elongated member of the linkage 130. Connection rod member 130*b* is received through a passage in a housing base member connector 124*a* of the housing base 124 and connection rod member 130*a* is received in a passage in a slide base connector 132*b* of the slide base 132. Linkage member 128 includes apertures 128*a* and 128*b* that pass through proximate opposite ends of an elongated member of linkage 128. Split connection rod member 130*a* is received in aperture 128*a* of linkage 128 and split connection rod member 130*b* is received in aperture 128*b* to couple the slide base 132 to the housing base 124 via linkage members 128 and 130. This arrangement moves the slide base 132 in relation with the dispensing tube 126 when the manipulation housing 120 is moved (depressed) in relation to the housing base 124. The depression of the manipulation housing 120 causes the dispensing opening 132*e* of the slide base 132 to align with the dispensing orifice 126*c* of the delivery tube 126.

A biasing slide cover 136 is coupled to the slide base 132. In particular in this embodiment, connecting fingers 136*a* with catching portions 136*b* of the slide cover 136 engage edges of the slide base 132 to couple the slide cover 136 to the slide base 132. The slide cover 136 and the track surface 132*a* of the slide base 132 form a passage in which the dispensing tube 126 is held. The slide cover 136 further includes a biasing member 136*c* that exerts a force on the dispensing tube 126 so the dispensing tube 126 maintains in contact with the track surface 132*a* of the slide base 132. A tip cover 138 (or shroud) is used to cover the slide base 132, the slide cover 136 and a portion of the dispensing tube 126. The tip cover 138 further provides support in an inner bore for an end of the dispensing tube 126 as illustrated in FIG. 1C.

Figure 1D:
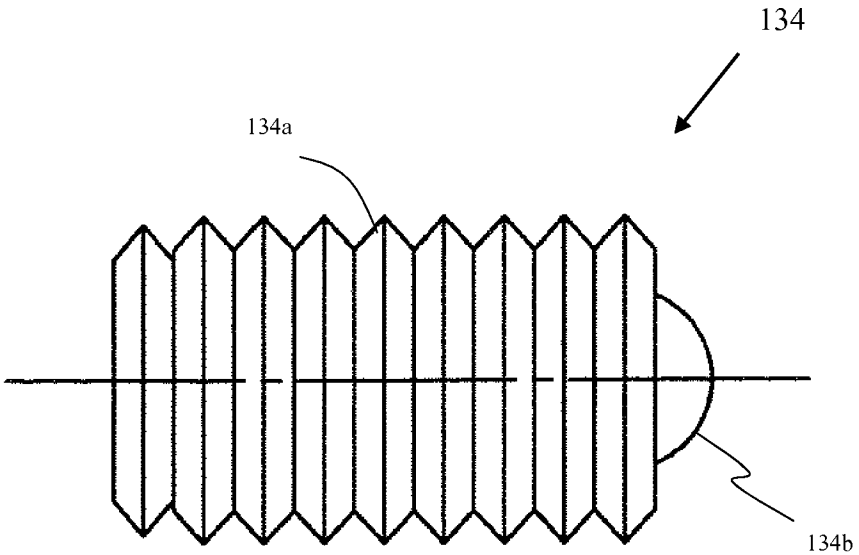
FIG. 1D is a side view of a spring plunger used in a pump head of one embodiment of the present invention.
Figure 1E:
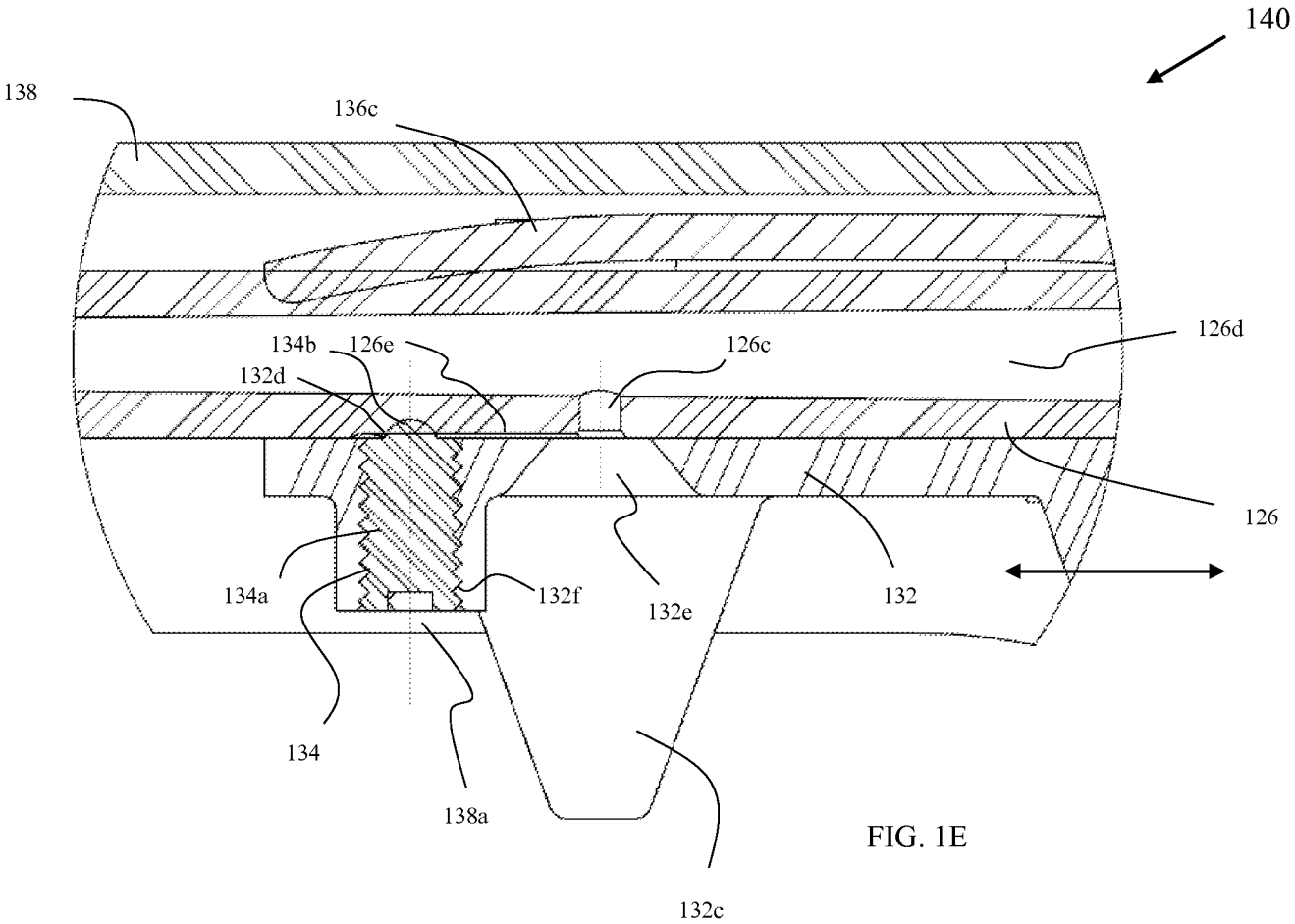
FIG. 1E is a close up view of a select section 140 of the cross-sectional side view of the pump head of FIG. 1C.

The pump head 106 in this embodiment further includes a spring plunger 134. A close up view of a spring plunger 134 of one embodiment is illustrated in FIG. 1D. The spring plunger 134 includes a plunger body 134*a* and a sealing component which is in this embodiment a plugging dome 134*b*. Referring to FIG. 1E, a close up view of section 140 of pump head 106 of FIG. 1C is illustrated. As illustrated in FIG. 1E, the plunger body 134 of the plunger in this embodiment is received in a threaded bore 132*f* in the slide base 132. The plugging dome 134*b* extends through a plunger passage 132*d* in the slide base 132 to selectively cover and seal the dispensing orifice 126*c* in the dispensing tube 126. The plunger body 134 includes a biasing member that asserts a force on plugging dome 134*b* through the plunger passage 132*d* to engage the dispensing tube 126. The dispensing tube 126 in this embodiment includes a guide groove 126*e* that guides the plugging dome 134*b* as the slide base 132 moves in relation to the dispensing tube 126. In one embodiment the plugging dome 134*b* is made from a material that is deformable to ensure a tight seal despite any minor tolerance issues.

In operation, as a user depresses the manipulation housing 120 towards the housing base 124, linkage 128 and 130 cause the slide base 132 to move in relation to the dispensing tube 126 unseating the plugging dome 134*b* from the dispensing orifice 126*c*. As the manipulation housing 120 is further depressed, the product is picked up and delivered to the dispensing tube 126. When the dispensing opening 132*e* of the slide base becomes aligned with dispensing orifice 126*c* of the dispensing tube 126, product is dispensed. This embodiment of the slide base 132 includes product guides 132*c* that provide a visual indication to a user where the product will be dispensed. When the user removes the depression force from the manipulation housing 120, the compression spring moves the manipulation housing 120 away from the housing base 124. This movement causes the linkage members 128 and 130 to move the slide base 132 again in relation to the dispensing tube 126. As the slide base 132 moves, the plugging dome 134*b* in the guide groove 126*e* moves towards the dispensing orifice 126*c* of the dispensing tube 126. As the manipulation housing 120 returns to its inactivation (resting) position via the compression spring 122, the plugging dome 134 of the spring plunger wipes and seals the dispensing orifice 126*c* of the dispensing tube 126. In one embodiment, the plugging dome 134*b* is part of an umbrella valve.

Figure 1G:
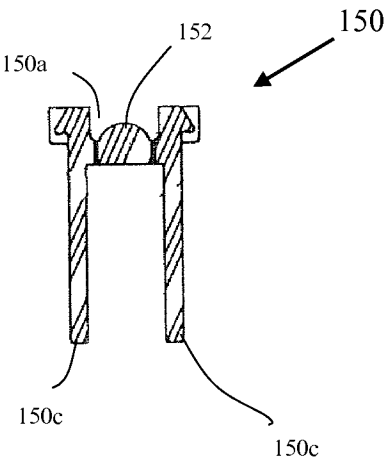
FIG. 1F through 1H are illustrations of a slide base of a pump head of another embodiment of the present invention.
Figure 1F:
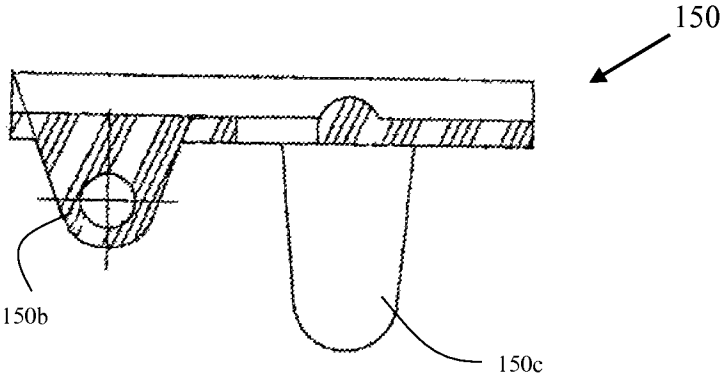
Figure 1H:
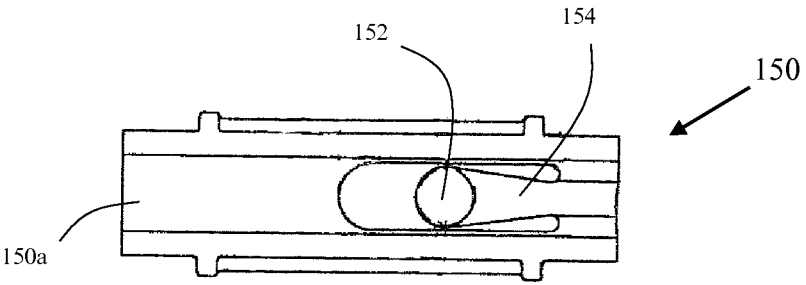
Figure 1J:
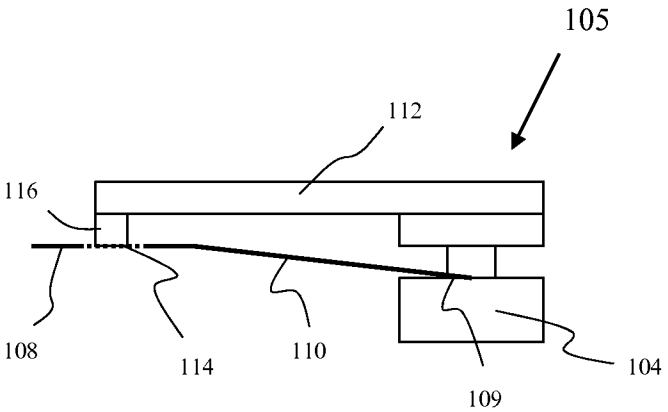
FIG. 1J is a side-view illustration of the dispensing pump head of FIG. 1I in a depressed position.
Figure 1I:
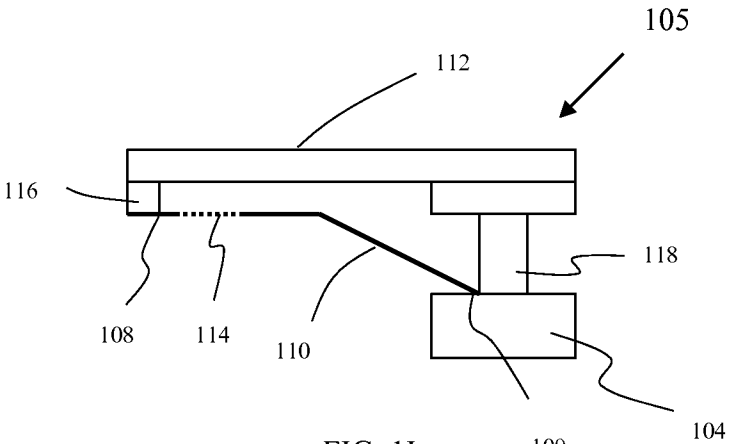
FIG. 1I is a side-view illustration of a dispensing pump head of another embodiment of the present invention in a neutral position.

FIGS. 1F through 1H illustrate another embodiment of a slide base 150. This slide base 150 includes product guides 150*c* and a slide base connector 150*b* similar to slide base 132 discussed above. In this embodiment, a central biasing tab portion 154 with a plugging dome 152 is used instead of the arrangement with the spring plunger 134 described above. FIGS. 1I and 1J further illustrate a general push arm wipe and seal embodiment and how it operates. In FIG. 1I, a pump head 105 is illustrated in a neutral (inactivated, resting) position. In this position, a portion of a sealing shroud 108 is covering the dispensing orifice 116 of the pump arm 112 when the pump head 105. In FIG. 1J, the pump head 105 has been depressed into the depressed (activation) position. This action causes the sealing shroud 108 to move to align a sealing shroud dispensing aperture 114 with the dispensing orifice 116 of the pump arm 112 thereby allowing product to flow out as illustrated. In particular, a first end 109 of a push arm 110 (linkage) is biased against a surface of the connector 104 so it cannot move when the pump head 105 and the activation rod 118 are depressed. Hence, the movement of the pump arm 112 (that is directly coupled to the pump head 105) in relation to the sealing shroud 108 which is coupled to a second end 111 of the push arm 110 aligns the opening 114 with the dispensing orifice 116. When the pump head 105 is allowed to go back into the neutral position, the sealing shroud 108 wipes the dispensing orifice 116 clean as it moves to seal the dispensing orifice 116. This action is also caused by the movement of the pump arm 112 in relation to the sealing shroud 108.

Figure 2B:
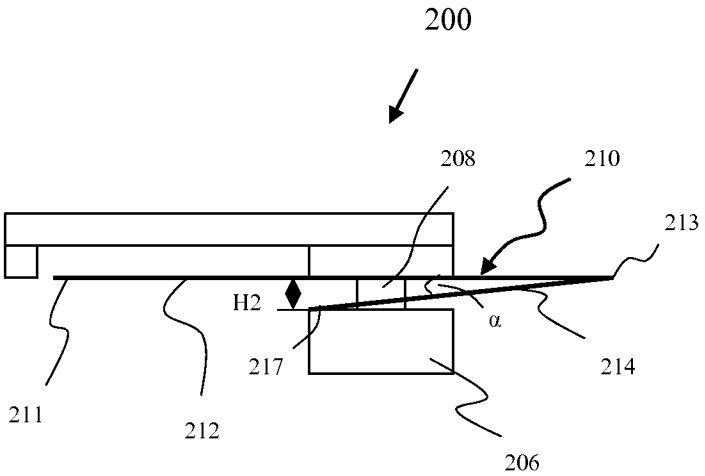
FIG. 2B is a side-view illustration of the dispensing pump head of FIG. 2A in a depressed position.
Figure 2A:
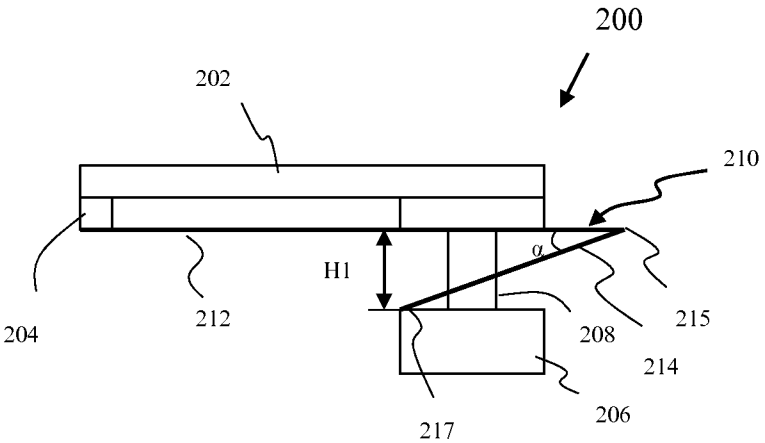
FIG. 2A is a side-view illustration of a dispensing pump head in a neutral position of another embodiment of the present invention.

FIGS. 2A and 2B illustrate a pump head 200 of another embodiment of a dispensing system. This embodiment can be referred to as pull (retracting) arm wipe and seal embodiment. FIG. 2A illustrates the pump head 200 in a neutral position and FIG. 2B illustrates the pump head 200 in a depressed position. The differences between the two positions are highlighted by the heights H1 and H2 in the respective Figures. As illustrated, the pump head 200 includes a pump arm 202. The pump arm 202 terminates in a dispensing orifice 204. The pump head 200 is further coupled to a first end of an activation rod 208 that slidably passes through connector 206. Connector 206 is designed to connect to a container that contains a product to dispense. This embodiment of the pump head 200 includes a retracting wipe and seal assembly 210 that includes a wipe and seal arm 212 and a biasing arm 214. The wipe and seal arm 212 includes a first end 211 and a second end 213. The first end 211 covers the dispensing orifice 204 when the pump head 200 is in the neutral position. The biasing arm 214 includes a first end 215 and second end 217. The first end 215 of the biasing arm 214 extends from the second end of the wipe and seal arm 212 at a select angle α. The second end 217 of the biasing arm 214 engages the connector 206.

When the pump head 200 is depressed it exerts a force on the wipe and seal arm 212. This force on the wipe and seal arm 212 bends the retracting wipe and seal assembly 210 at the connection between the wipe and seal arm 212 and the biasing arm 214 thereby reducing angle α. This action causes the first end of the wipe and seal arm 212 to uncover the dispensing orifice 204 of the pump arm 202. When the pump head 200 is allowed to return to the neutral position, the biasing arm 214 forces the wipe and seal arm 211 of the retracting wipe and seal assembly 210 to stay in contact with the pump head 200 thereby increasing angle α. This action causes the first end of the wipe and seal arm 212 to wipe the dispensing orifice 204 of the pump arm 202 as it crosses the dispensing orifice 204 and then seals the dispensing orifice 204. In another embodiment (not shown) aim 112 is mechanically coupled to pump arm 202, dispensing orifice 204 and pump head 200 through a slip-channel mechanism. This arrangement keeps wipe and seal arm 212 in contact with pump arm 202, dispensing orifice 204 and pump head 200 when the pump head 200 is returned to the neutral position following a dispense of product.

Figure 3B:
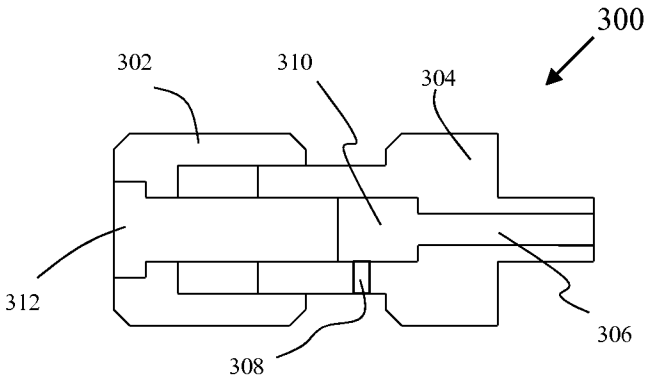
FIG. 3B is a side cross-sectional view of the dispensing nozzle of FIG. 3A in an activated configuration.
Figure 3A:
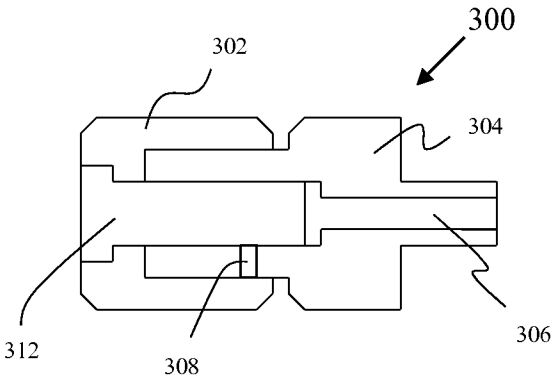
FIG. 3A is a side cross-sectional view of a dispensing nozzle in an inactivated configuration of one embodiment of the present invention.

FIGS. 3A and 3B illustrate a dispensing nozzle 300 of a dispensing device of an embodiment of the present invention. In particular, dispensing nozzle 300 illustrates another wipe and seal embodiment. FIG. 3A illustrates the dispensing nozzle 300 in a closed (inactive) position and FIG. 3B illustrates the dispensing nozzle 300 in an open (activated) position. The dispensing nozzle 300 includes a dispensing head 304 (first housing member) and a cover 302 (second housing member). A portion of the cover 302 slidably encases a portion of the dispensing head 304. The cover 302 includes a piston 312. The piston has a portion that is slidably received in a chamber 310 of the dispensing head 304. The dispensing head 304 includes a product passage 306 that leads to the chamber 310. A dispensing orifice 308 provides a path from the chamber 310 to dispense the product. Referring to FIG. 3A, when product is pushed into passage 306 of the dispensing head it provides a pressure on the piston 312 of the cover 302 that is slidably engaged in the chamber 310 of the dispensing head 304. In one embodiment, the product is forced into passage 306 via depressing a pump head of a dispensing device. Pressure on the piston 312 moves the cover 302 to a position that allows the product to move into the chamber 310 and out the dispensing orifice 308. The product will not flow out of the dispensing orifice 308 until the cover 302 has completely exposed (uncovered) the dispensing orifice 308. This position is illustrated in FIG. 3B. Once the pressure from the product on the piston 312 subsides, the cover returns to the position with the assistance of reverse pressure which is created by an outside force (spring, etc. . . . ) combined with the natural "suck-back" of the pump illustrated in FIG. 3A thereby wiping and sealing the dispensing orifice 308.

Figure 4B:
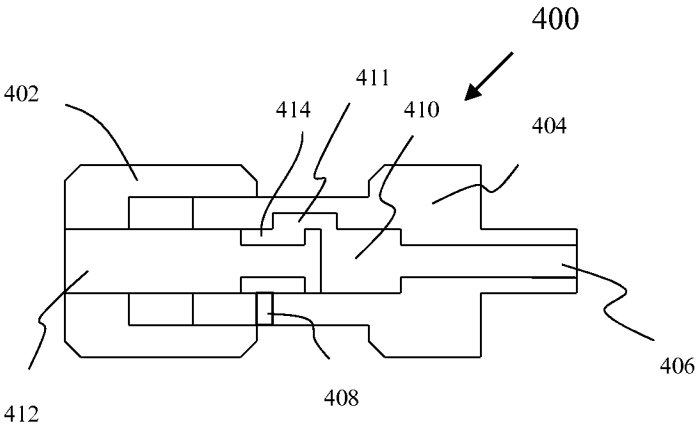
FIG. 4B is a side cross-sectional view of the dispensing nozzle of FIG. 4B in an configuration position.
Figure 4A:
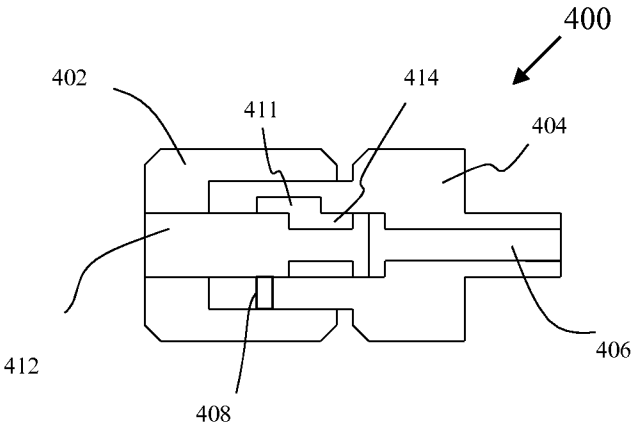
FIG. 4A is a side cross-sectional view of a dispensing nozzle in an inactivated configuration of one embodiment of the present invention.

Another embodiment of a dispensing nozzle 400 is illustrated in FIGS. 4A and 4B. FIG. 4A illustrates the dispensing nozzle 400 in a closed (inactive) position and FIG. 4B illustrates the dispensing nozzle 400 in an open (activated) position. The dispensing nozzle 400 includes a dispensing head 404 and a cover 402. A portion of the cover 402 slidably encases a portion of the dispensing head 404. The cover 402 includes a piston 412. The piston 412 has a portion that is slidably received in a chamber 410 of the dispensing head 404. The portion of the piston 412 that is received in the chamber in this embodiment includes a channel 414. The dispensing head 404 includes a product passage 406 that leads to the chamber 410. The chamber 410 in this embodiment includes a groove 411. A dispensing orifice 408 provides a path from the chamber 410 to dispense the product. Referring to FIG. 4A, when product is pushed into passage 406 of the dispensing head it provides a pressure on the piston 412 of the cover 402 that is slidably in the chamber 410 of the dispensing head 404. In one embodiment the product is forced into passage 406 via depressing a pump head of a dispensing device. Pressure on the piston 412 moves the cover 402 to a position that allows the product to move into chamber 410 through groove 411 in the chamber 410 then through channel 414 of the piston and out dispensing orifice 408. This position is illustrated in FIG. 4B. The path in this embodiment helps regulate the flow of product out of the dispensing orifice 408 in a desired fashion. Once the pressure from the product on the piston 412 subsides, the cover returns to the position illustrated in FIG. 4A thereby wiping and sealing the dispensing orifice 408. In one embodiment, a biasing member (not shown) forces the cover back to the position illustrated in FIG. 4A after the product is dispensed.

Figure 5A:
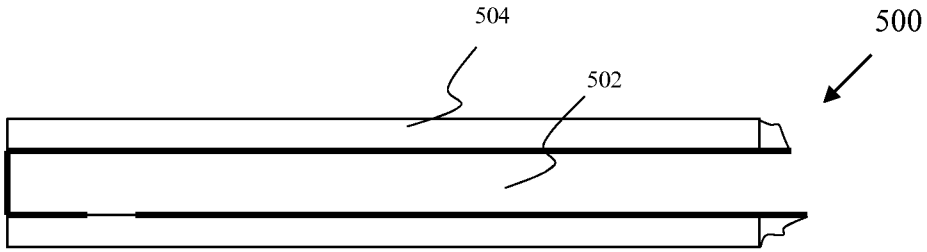
FIG. 5A is a side cross-sectional view of a dispensing arm in a retracted configuration of one embodiment of the present invention.
Figure 5B:
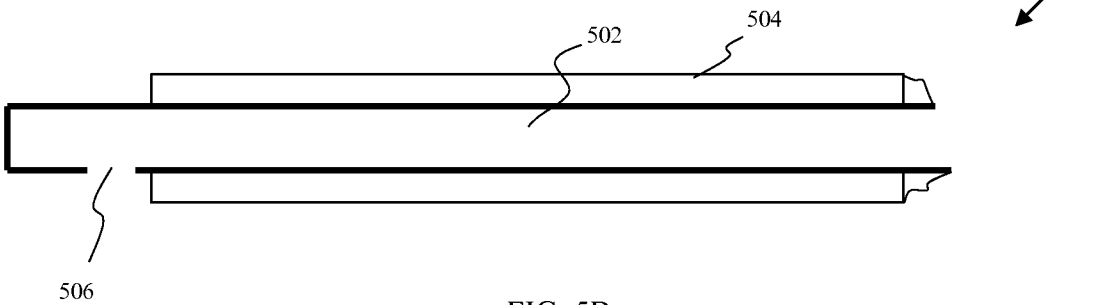
FIG. 5B is a side cross-sectional view of the dispensing arm of FIG. 5A in a dispensing configuration.

Referring to FIGS. 5A and 5B an example of another dispensing nozzle 500 of an embodiment is illustrated. FIG. 5A illustrates the dispensing nozzle 500 in a retracted (inactive) position and FIG. 5B illustrates the dispensing nozzle 500 in a dispensing (activated) position. The dispensing nozzle 500 includes an inner tube 502 that provides a passage for the product and an outer tube 504 that slidably encases the inner tube 502. The inner tube 502 includes a dispensing orifice 506. In the retracted position of FIG. 5A, the dispensing orifice 506 is covered by the outer tube 504. When product in the inner tube 502 is pressurized, an end of the inner tube 502 near the dispensing orifice 506 is forced out of the outer tube 504 until the dispensing orifice 506 in the inner tube is no longer covered by the outer tube 504. Once, the dispensing orifice 506 is uncovered by the outer tube 504, product flows there through thereby releasing the pressure on the inner tube 502. Once the pressure is released, the inner tube 502 retracts back into the outer tube 504. As the inner tube 502 retracts, the outer tube 504 wipes and seals the dispensing orifice 506. In one embodiment, the retraction motion of the inner tube 502 is done with the use of a biasing member (not shown) pushing on the inner tube 502 in an opposite direction than the pressure produced by the product. In one embodiment, the pressure on the product is the result of a dispensing pump device similar to the dispensing device 100 of FIG. 1 including a pump head 106, activation rod 118, connector 104 and container 102.

Figure 6A:
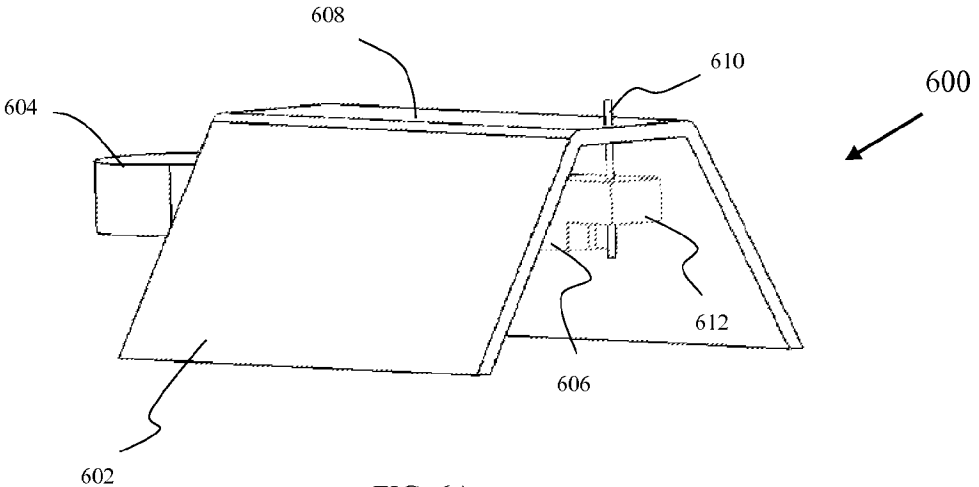
FIG. 6A is a side cross-sectional view of a portion of a dispensing device in a neutral position of another embodiment of the present invention.
Figure 6B:
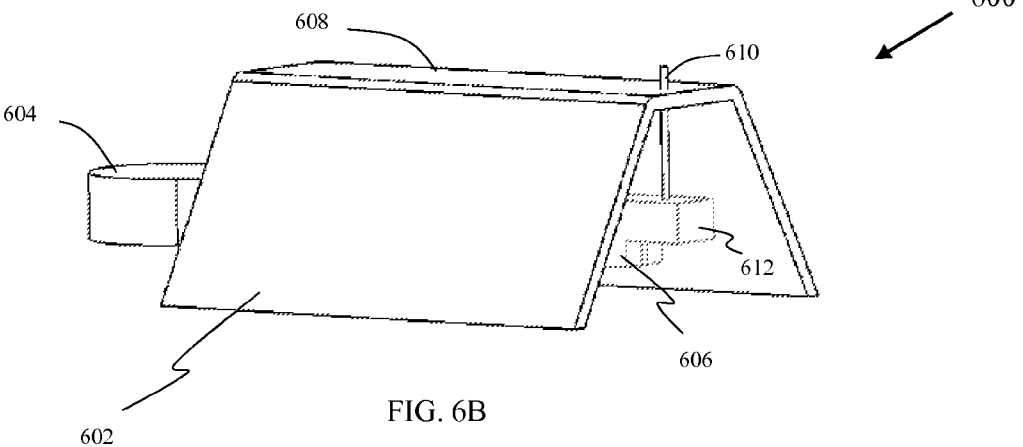
FIG. 6B is a side cross-sectional view of the portion of the dispensing device of FIG. 6A in a depressed position.

FIGS. 6A and 6B further illustrate an embodiment of another dispensing system 600 with a wipe and seal function. In FIG. 6A the dispensing system 600 is in a neutral position and in FIG. 6B the dispensing assembly 600 is in a depressed position. The dispensing assembly 600 includes a pump head 604. The pump head 604 is in communication with a dispensing tube 606 that provides a path for product to a nozzle 612 having a dispensing orifice. The dispensing assembly 600 further includes a hood 602. The hood 602 is solidly coupled to a product container (not shown) in one embodiment. A pin 610 passes through and is captured by the hood 602. In particular in this embodiment, the pin passes through a first side 608 of the hood and extends partially through the hood 602. The pin is further slidably received in a pin passage in the nozzle 612 that extends into the dispensing orifice. When the dispensing head 600 is in the neutral position, the pin 610 blocks the product (fluid) path (i.e. seals the path) thereby preventing the exposure of the non-dispensed product to ambient air. In this embodiment, the nozzle 612 moves along with the pump head 604. Hence, when the pump head 604 is depressed, as illustrated in FIG. 6B, the nozzle 612 also moves in relation to the pin 610. In the depressed position, a path 614 is formed around the pin 610 that allows the product to be dispensed through the nozzle 612. When the pump head 604 is allowed to return to the neutral position, the pin 610 wipes and seals the dispensing orifice in the nozzle 612.

Figure 7B:
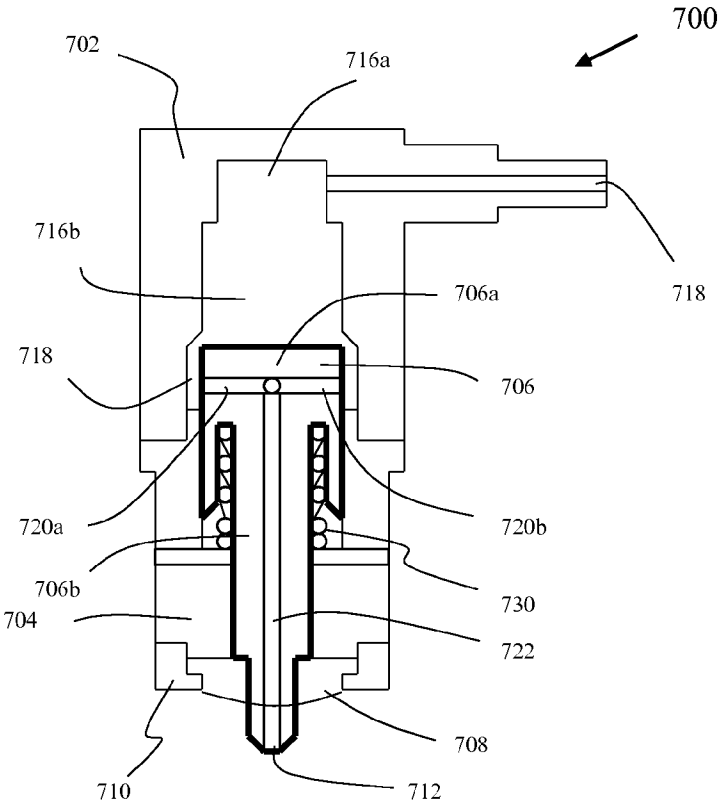
FIG. 7B is a cross-sectional side view of the portion of dispensing nozzle of FIG. 7A in an activated configuration.
Figure 7A:
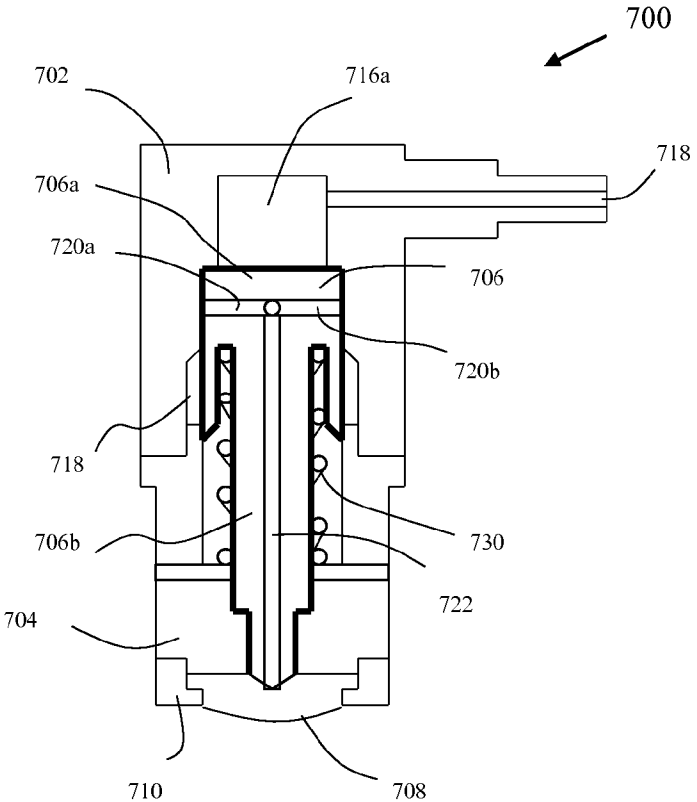
FIG. 7A is a cross-sectional side view of yet another embodiment of a dispensing nozzle of the present invention in an inactivated configuration.

Another embodiment of a nozzle 700 of a dispensing system is illustrated in cross-sectional views of FIGS. 7A and 7B. This embodiment of a nozzle includes a first housing member 702 that is coupled to a second housing member 704. The first housing member 702 includes a receiving passage 718 in which product is delivered to the nozzle 700. The receiving passage 718 extends to inner chambers 716*a* and 716*b* in the first housing 702. A piston 706 is received within the first and second housings 702 and 704. In an embodiment, pressure from the product moves the piston 706 within the housing members 702 and 704 when product is to be dispensed. FIG. 7A illustrates the nozzle in an inactivated (neutral) position. In this position, a piston head 706*a* of the piston 706 in chamber 716*b* effectively seals product in chamber 716*a* from ambient air. In one embodiment, the piston 706 is acted upon by a bias force from a biasing member 730, such as but not limited to, a spring, to keep the piston head 706*a* in chamber 716*b*. When product is to be dispersed, pressure from the product counters the biasing force moving the piston head 706*a* of the piston 706 out of the second chamber 716*b*. This activated position of the nozzle 700 is illustrated in FIG. 7B. In this position, the product flows around the piston head 706*a* into chamber 718 and into internal passages 720*a* and 720*b* having openings on the side of the piston head 706*a*. The product then flows through an internal passage 722 in the piston shaft 706*b* and out a dispensing orifice 712 in the end of the piston shaft 706*b*. As illustrated, in FIG. 7B, the end of the piston shaft extends through a silicon valve 708 when the nozzle 700 is in the activated position. A retaining cap 710 retains the silicon valve 708 on the nozzle 700. Once the pressure from the fluid is removed, the biasing member 730 will retract the piston 706 back to the inactivated position discussed above.

Figure 8B:
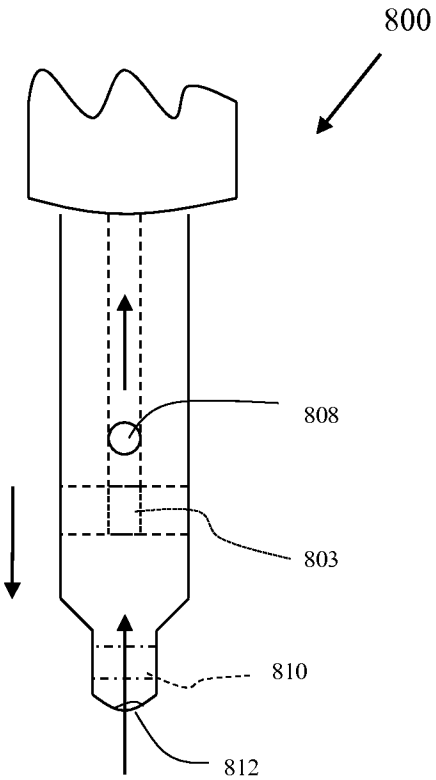
FIG. 8B is a side view of the pick up portion of the dispensing device of FIG. 8A in an activated position.
Figure 8A:
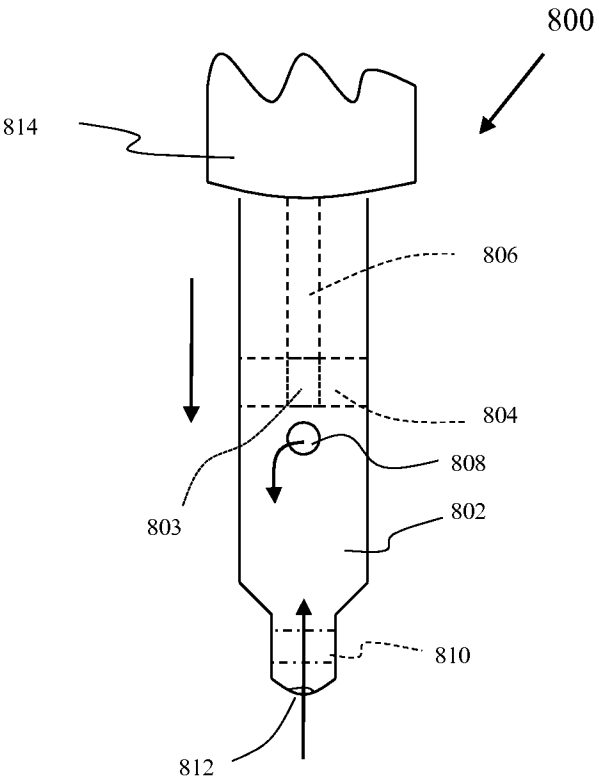
FIG. 8A is a side view of a pick up portion of a dispensing device in an inactivated position of one embodiment of the present invention.

Some embodiments implement a delay mechanism that delays the dispensing of product until a path to the dispensing orifice is fully opened. These embodiments prevent an unwanted spray pattern out of the dispensing orifice due to a partially blocked path. FIGS. 8A and 8B illustrate a portion of a dispensing device 800 including a delay mechanism of one embodiment. FIG. 8A illustrates a portion of a dispensing device 800 in a neutral position and FIG. 8B illustrates the portion of the dispensing device 800 in a depressed position. The portion of the dispensing device 800 includes a connector 814 and an activation rod 806 similar to the activation rod 118 and connector 104 of FIG. 1A. The portion of the dispensing device 800 further includes a pick up tube 802 (cylinder). The cylinder 802 is received in a container (not shown) that contains product. Inside the cylinder 802 is a piston 804 that is coupled to the activation rod 806. The piston 804 moves up and down in the cylinder 802 based on the movement of the activation rod 806 that is in turn coupled to a pump head, such as pump head 106 of FIG. 1. The movement of the piston 804 away from the connector 814 causes product to be forced through a passage in the piston 804 and the activation rod 806 as is known in the art. The portion of the dispensing device 800 further includes an intake orifice 812 and a check valve 810 in this embodiment. The intake orifice 812 provides a passage for the product in the container into the pickup tube 802 and the check valve 810 only allows the product to pass in one direction (into the pickup tube 802).

The delay mechanism in this embodiment includes a bleeder hole 808 in cylinder 802 that allows product to escape the cylinder 802 when the piston 804 is above the bleeder hole 808. In operation, as the pump head (not shown) is depressed, the activation rod 806 pushes the piston 804 towards the intake orifice 812. This action causes the product in the cylinder 802 to compress. The product, however, that is being compressed by the piston 804 will exit the bleeder hole 808 instead of traveling through the dispensing device to a dispensing orifice as long as the piston 804 is between the connector 814 and the bleeder hole 808. During the time when the piston 804 is between the connector 814 and the bleeder hole 808 and moving towards the bleeder hole 808, the wipe and seal embodiments as discussed above are being moved to provide an unobstructed path through the respective dispensing orifices. Hence, the time delay caused by travel time it takes for the piston 804 to reach the bleeder hole 808 allows for the wipe and seal embodiments as discussed above to be removed to provide an unobstructed path for the product out of the dispensing device. Once, the piston 804 passes the bleeder hole 808 it acts as known in the art causing the product to be forced into the passages (not shown) through the cylinder and the activation rod and out through the dispensing orifice as discussed in embodiments described above. As discussed, the delay caused by the bleeder hole 808 provides time needed to clear the path before product is dispensed so a desired spray pattern is achieved out of the dispensing orifice.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A product dispensing system comprising:

a dispensing device configured and arranged to pass product out of a dispensing orifice in the product dispensing system;

a sealing assembly configured and arranged to wipe and seal the dispensing orifice to prevent exposure of unused product with ambient air when the product dispensing system is not dispensing product; and a delay mechanism configured and arranged to delay the dispensing of product out the dispensing orifice until the sealing assembly is fully removed from sealing the dispensing orifice, wherein the delay mechanism further includes, a cylinder, the cylinder having a bleeder hole at a select location, a piston slidably received in the cylinder, the piston configured and arranged to pass the bleeder hole in the cylinder as the piston moves in the cylinder, and a check valve coupled proximate an end of the cylinder configured and arranged to allow product to only pass into the cylinder.

2. The product dispensing system of claim 1, wherein the dispensing device further comprises:

a housing base;

a manipulation housing configured and arranged to be depressed towards the housing base by a user;

a biasing member configured and arranged to assert a force pushing the manipulation housing away from the housing base;

a dispensing tube coupled to receive product from the manipulation housing, the dispensing tube having a dispensing orifice to dispense product;

a slide base slidably engaging the dispensing tube, the slide base configured and arranged to selectively wipe and seal the dispensing orifice of the dispensing tube; and at least one linkage coupled between the slide base and the housing base.

3. The product dispensing system of claim 2, further comprising:

a plugging dome coupled to the slide base to selectively seal the dispensing orifice of the dispensing tube.

4. The product dispensing system of claim 3, wherein the plugging dome is made from a deformable material.

5. The product dispensing system of claim 1, further comprising:

the dispensing device including a housing member, the housing member having a product passage, the dispensing orifice in fluid communication with the product passage; and the sealing assembly including a piston, the piston being slidably engaged with the housing member, the piston configured and arranged to selectively wipe and seal the dispensing orifice.

6. The product dispensing system of claim 5, further comprising:

the piston including a channel configured and arranged to allow product to pass out the dispensing orifice when the piston is in a select location in relation to the housing member.

7. The product dispensing system of claim 5, further comprising:

a biasing member coupled to assert a biasing force on the piston to position the piston in relation to the housing member in a neutral position when not activated.

8. The product dispensing system of claim 1, further comprising:

the dispensing device including an inner tube having a product passage, the dispensing orifice opening into the product passage; and the sealing assembly at least partially encasing the inner tube, the inner tube being slidably engaged with the sealing assembly, the sealing assembly configured and arranged to selectively wipe and seal the dispensing orifice.

9. The product dispensing system of claim 1, further comprising:

the dispensing device including a nozzle, the nozzle including the dispensing orifice, the nozzle further having a pin passage aligned with the dispensing orifice; and the sealing assembly including a pin, the pin slidably received in the pin passage to selectively wipe and seal the dispensing orifice.

10. A product dispensing system 5, comprising:

a dispensing device configured and arranged to pass product out of a dispensing orifice in the product dispensing system;

a sealing assembly configured and arranged to wipe and seal the dispensing orifice to prevent exposure of unused product with ambient air when the product dispensing system is not dispensing product;

wherein the dispensing device further includes, a housing base, a manipulation housing configured and arranged to be depressed towards the housing base by a user, a biasing member configured and arranged to assert a force pushing the manipulation housing away from the housing base, a dispensing tube coupled to receive product from the manipulation housing, the dispensing tube having a dispensing orifice to dispense product, a slide base slidably engaging the dispensing tube, the slide base configured and arranged to selectively wipe and seal the dispensing orifice of the dispensing tube, and at least one linkage coupled between the slide base and the housing base; and a plugging dome coupled to the slide base to selectively seal the dispensing orifice of the dispensing tube, wherein the dispensing tube has a guide groove leading to the dispensing orifice for the plugging dome to be received in when the slide base moves in relation to the dispensing tube.

11. A product dispensing system comprising:

a dispensing device configured and arranged to pass product out of a dispensing orifice in the product dispensing system;

a sealing assembly configured and arranged to wipe and seal the dispensing orifice to prevent exposure of unused product with ambient air when the product dispensing system is not dispensing product; and the dispensing device including, a housing member, the housing member having a product passage, the dispensing orifice in fluid communication with the product passage, and the sealing assembly including a piston, the piston being slidably engaged with the housing member, the piston configured and arranged to selectively wipe and seal the dispensing orifice, the piston having one or more passages configured and arranged to pass product when in an activated position.

12. A product dispensing system comprising:

a container configured and arranged to hold product to be dispensed;

a pickup tube configured and arranged to be received in the container to pick up product;

a housing base;

a manipulation housing configured and arranged to be depressed towards the housing base by a user, the manipulation housing in fluid communication with the pickup tube to receive product held in the container via the pickup tube;

a biasing member configured and arranged to assert a force pushing the manipulation housing away from the housing base;

a dispensing tube coupled to receive product from the manipulation housing, the dispensing tube having a dispensing orifice to dispense product;

a slide base slidably engaging the dispensing tube, the slide base configured and arranged to selectively wipe and seal the dispensing orifice of the dispensing tube;

at least one linkage coupled between the slide base and the housing base;

a plugging dome coupled to the slide base to selectively seal the dispensing orifice of the dispensing tube; and wherein the dispensing tube has a guide groove leading to the dispensing orifice for the plugging dome to be received in when the slide base moves in relation to the dispensing tube.

13. The product dispensing system of claim 12, wherein the plugging dome is made from a deformable material.

14. The product dispensing system of claim 12, wherein the plugging dome is part of a spring plunger that is coupled to the slide base to selectively wipe and seal the dispensing orifice.

15. The product dispensing system of claim 12, further comprising:

a biasing slide cover configured and arranged to bias the dispensing tube into the slide base.

16. The product dispensing system of claim 12, further comprising:

at least one product guide coupled to the slide base configured and arranged to provide a visual indicator of the dispensing orifice to a user.

* * * * *

UNITED STATES PATENT AND TRADEMARK OFFICE

CERTIFICATE OF CORRECTION

PATENT NO. : 8,444,019 B2
APPLICATION NO. : 12/851905
DATED : May 21, 2013
INVENTOR(S) : Ryan D. Lucey et al.

It is certified that error appears in the above-identified patent and that said Letters Patent is hereby corrected as shown below:

IN THE CLAIMS

Claim 10, Column 10, Line 34: "A product dispensing system 5, comprising:" should read as follows:
--A product dispensing system, comprising:--.

Signed and Sealed this
Second Day of February, 2016

Michelle K. Lee

Michelle K. Lee
*Director of the United States Patent and Trademark Office*